US012188484B2

(12) United States Patent
Uni

(10) Patent No.: US 12,188,484 B2
(45) Date of Patent: Jan. 7, 2025

(54) CENTRIFUGAL BLOWER

(71) Applicant: SHINANO KENSHI KABUSHIKI KAISHA, Nagano (JP)

(72) Inventor: Masahiko Uni, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 0 days.

(21) Appl. No.: 18/532,688

(22) Filed: Dec. 7, 2023

(65) Prior Publication Data

US 2024/0229824 A1 Jul. 11, 2024

(30) Foreign Application Priority Data

Jan. 11, 2023 (JP) ..... 2023-002041

(51) Int. Cl.

| | |
|---|---|
| ***F04D 29/42*** | (2006.01) |
| ***F04D 17/10*** | (2006.01) |
| ***F04D 29/28*** | (2006.01) |
| ***F04D 29/44*** | (2006.01) |

(52) U.S. Cl.

CPC ..... *F04D 29/4246* (2013.01); *F04D 29/28* (2013.01); *F04D 29/42* (2013.01); *F04D 29/4213* (2013.01); *F04D 29/4226* (2013.01); *F04D 29/44* (2013.01); *F04D 17/10* (2013.01)

(58) Field of Classification Search

CPC ..... F04D 29/4246; F04D 29/28; F04D 29/42; F04D 29/4213; F04D 29/4226; F04D 29/44; F04D 17/10

See application file for complete search history.

(56) References Cited

U.S. PATENT DOCUMENTS

2017/0240078 A1 8/2017 Ishii et al.
2021/0270291 A1* 9/2021 Ichihashi ..... F04D 29/4226

FOREIGN PATENT DOCUMENTS

JP 2015-174580 10/2015
JP 6793803 12/2020

OTHER PUBLICATIONS

Machine Translation of Japanese Patent Publication Jp 6793803B1; Inventor: UNI; Title: Centrifugal Blower, Published: Dec. 2, 2020. (Year: 2020).*

* cited by examiner

*Primary Examiner* — Mary A Davis
(74) *Attorney, Agent, or Firm* — Stephen J. Weyer, Esq.; Stites & Harbison, PLLC

(57) ABSTRACT

Lock protrusions 4*s* are projectingly provided to a peripheral edge part of an intake opening part 4*c* of a first case 4*a* at a plurality of positions. A removal hole 4*t* whose width becomes narrower from an upstream side to a downstream side in a rotational direction of a centrifugal fan 2 is provided to extend on a radial-direction outer side of each lock protrusion 4*s*. An inclined surface F is chamfered to continue to an outer-peripheral-side peripheral edge part 4*t*1 of the removal hole 4*t*, the peripheral edge part 4*t*1 facing to an inner wall surface 4*a*1 of the first case 4*a*.

2 Claims, 6 Drawing Sheets

NOISE FFT ANALYSIS RESULT
BEFORE IMPROVEMENT

NOISE FFT ANALYSIS RESULT
AFTER IMPROVEMENT

CENTRIFUGAL BLOWER

CROSS-REFERENCE TO RELATED APPLICATION

This application is based upon and claims the benefit of priority of the prior Japanese Patent Application No. 2023-002041, filed on Jan. 11, 2023, and the entire contents of which are incorporated herein by reference.

TECHNICAL FIELD

The present disclosure relates to a centrifugal blower used for, for example, a seat air-conditioning or an HVAC (Heating, Ventilation, and Air Conditioning) apparatus, etc.

BACKGROUND ART

For example, when a driver is in contact with a backrest or a seating part of a seat for a long period of time, such as during long-distance travel by driving a car, air which is high in temperature and humidity clings and discomfort increases. Therefore, a seat air-conditioning apparatus to adjust high-temperature and humidity air which is likely to be accumulated mainly at the backrest portion and the seating portion is used.

As the seat air-conditioning apparatus, types of the seat air-conditioning apparatus exist in which air is blown out from a seat, and in which air is drawn in and discharged from a seat. Here, a seat air-conditioning apparatus of the drawing-in type for which an air-conditioning effect of higher comfortability can be expected is described. The drawing-in type air-conditioning apparatus sucks high-temperature and humidity air accumulated at the backrest portion and the seating portion to be removed from the area, and therefore, an air-conditioning effect can be achieved.

For example, a seat air-conditioning system which suppresses noise caused when air flows into an intake port of an air blower from a seat has been proposed. The intake port is formed at an upper-case part of a case which is assembled by the upper-case part and a lower-case part being threadedly fastened together at four corners. A motor including a stator and a rotor, and a centrifugal multi-blade fan are rotatably supported at the lower-case part. The rotor is assembled integrally with the centrifugal multi-blade fan. When the motor rotates and the centrifugal multi-blade fan rotates, air is drawn in from a seat side through the intake port of the upper-case part, and blown out from an outlet port which opens at four sides of the case (PTL 1: JP-A-2015-174580).

Moreover, in a seat air-conditioning apparatus, since an intake opening part is assembled to face an attachment part of a seat air-conditioning duct at a backrest portion and a seat portion, lock protrusions for snap-fit locking may projectingly be provided to a peripheral edge part of the intake opening part of a case body at a plurality of positions in a peripheral direction (PTL 2: JP-B-6793803).

SUMMARY OF INVENTION

Technical Problem

The lock protrusion described above is formed integrally with the case body while being molded together. Therefore, a tip end of the lock protrusion becomes an undercut part, and for mold removal, formation of a removal hole for a slide core is required to be formed at an outer peripheral side of the snap-fit. A centrifugal fan is formed such that an impeller which is formed upright to a main plate is sparse whereas a length of the impeller in a radial direction is large. Therefore, an upper end of a blade of the impeller rotates while passing the immediately underneath of the removal hole. As a result of the rotation of the impeller, air drawn in from the intake opening part is compressed and led to an air blowing path provided at an outer peripheral side of the case body and is discharged, and therefore air at a high pressure and a high flow rate flows immediately underneath of the removal hole. Thus, the removal hole is strongly affected by pulsation of air, and peak noise which depends on the number of blades and a rotational speed of the centrifugal fan is caused (see FIG. 6A). Note that FIG. 6A shows a result of frequency analysis of noise by using an FFT analyzer.

Particularly, in order for thickness reduction, the main plate near a middle part of the impeller is formed to be swelled in a dome shape in an axial direction, and a motor is accommodated therein. Therefore, an opening diameter of the intake opening part of the case body is large, and room for changing a form of the lock protrusion depending on specifications of an attachment part is small.

Solution to Problem

The present invention has been accomplished to solve these problems, and one object thereof is to provide a centrifugal blower in which occurrence of peak noise is reduced by a shape of a removal hole provided on an outer peripheral side of a lock protrusion which is provided integrally to a case body, being improved.

In order to achieve the above-described object, the present invention includes the following configuration. A centrifugal blower includes a case body which accommodates therein a centrifugal fan and a motor which rotary drives the centrifugal fan, and draws in air from a radial-direction middle part of the case body and discharges compressed air from a radial-direction outer side of the case body. The case body includes a first case and a second case. The first case is assembled to cover the centrifugal fan, and provided with an intake opening part at a radial-direction middle part, and a first air blowing path formed at a radial-direction outer side. The second case axially supports the motor to be rotatable, and is provided with a second air blowing path formed on a radial-direction outer side of an outer-peripheral end part of the centrifugal fan. The second air blowing path is combined with the first air blowing path. Lock protrusions are projectingly provided to a peripheral edge part of the intake opening part of the first case at a plurality of positions. A removal hole of which a width becomes narrower from an upstream side to a downstream side in a rotational direction of the centrifugal fan is provided to extend on a radial-direction outer side of each lock protrusion. A chamfered inclined surface is formed to continue to a peripheral edge part of the removal hole, the peripheral edge part facing to an inner wall surface of the first case. As described above, the removal hole whose width becomes narrower along the rotational direction of the centrifugal fan is provided to extend on the outer peripheral side of the lock protrusion. Therefore, the lock protrusion can be resin-molded integrally with the first case even when a mold undercut part is caused. By the chamfered inclined surface being formed to continue to the peripheral edge part of the removal hole facing to the inner wall surface of the first case, occurrence of peak noise which depends on the number of blades and a rotational speed of the centrifugal fan can be reduced.

When the removal hole is formed in a given range including and from a further upstream side to a further downstream side in the rotational direction of the centrifugal fan, of the peripheral edge part of the intake opening part at which the lock protrusion is provided, while easiness in deformation of the lock protrusion during assembling and disassembling of the centrifugal blower by snap-fit is maintained, pulsation of air due to rotation of the centrifugal fan is dispersed, and pressure fluctuation can be suppressed.

Advantageous Effects of Invention

The centrifugal blower can be provided, in which occurrence of peak noise is reduced by the shape of the removal hole provided on the outer peripheral side of the lock protrusion which is provided integrally to the case body, being improved.

DESCRIPTION OF EMBODIMENTS

Hereinafter, referring to the accompanying drawings, one embodiment of a centrifugal blower according to the present invention is described. First, an outline configuration of the centrifugal blower is described with reference to FIGS. 1 to 3. As a motor M, a brushless DC motor is used, and in this embodiment, an outer rotor type motor is used. Note that an inner rotor type motor may be used.

Figure 1:
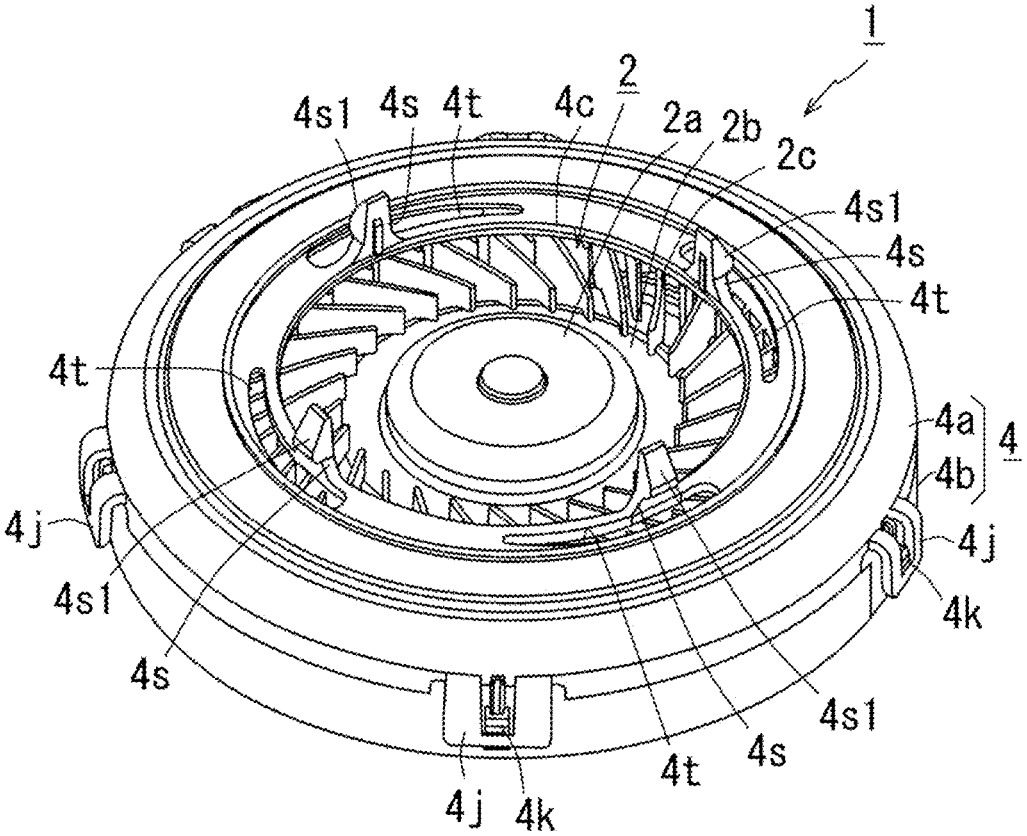
FIG. 1 is a perspective view of a centrifugal blower.

As illustrated in FIG. 1, in a centrifugal blower 1, a centrifugal fan 2 and a rotor 3 are assembled integrally, and the motor M (see FIG. 5) which rotary drives these components is accommodated in a case body 4. As illustrated in FIG. 1, air is drawn in from a radial-direction middle part of the case body 4, and air compressed to a radial-direction outer side by rotation of the centrifugal fan 2 is discharged to a side opposite from the air intake in the radial direction. As illustrated in FIG. 1, the case body 4 is formed by combination of a first case 4*a* which is assembled to cover the centrifugal fan 2, and a second case 4*b* which axially supports the motor M (the rotor 3 and a stator 5; see FIG. 5) to be rotatable. The first case 4*a* and the second case 4*b* are integrally assembled by a lock piece 4*j* provided to a side-part outer periphery of the first case 4*a* being locked to a lock part 4*k* provided to a side-part outer periphery of the second case 4*b*.

Figure 5:
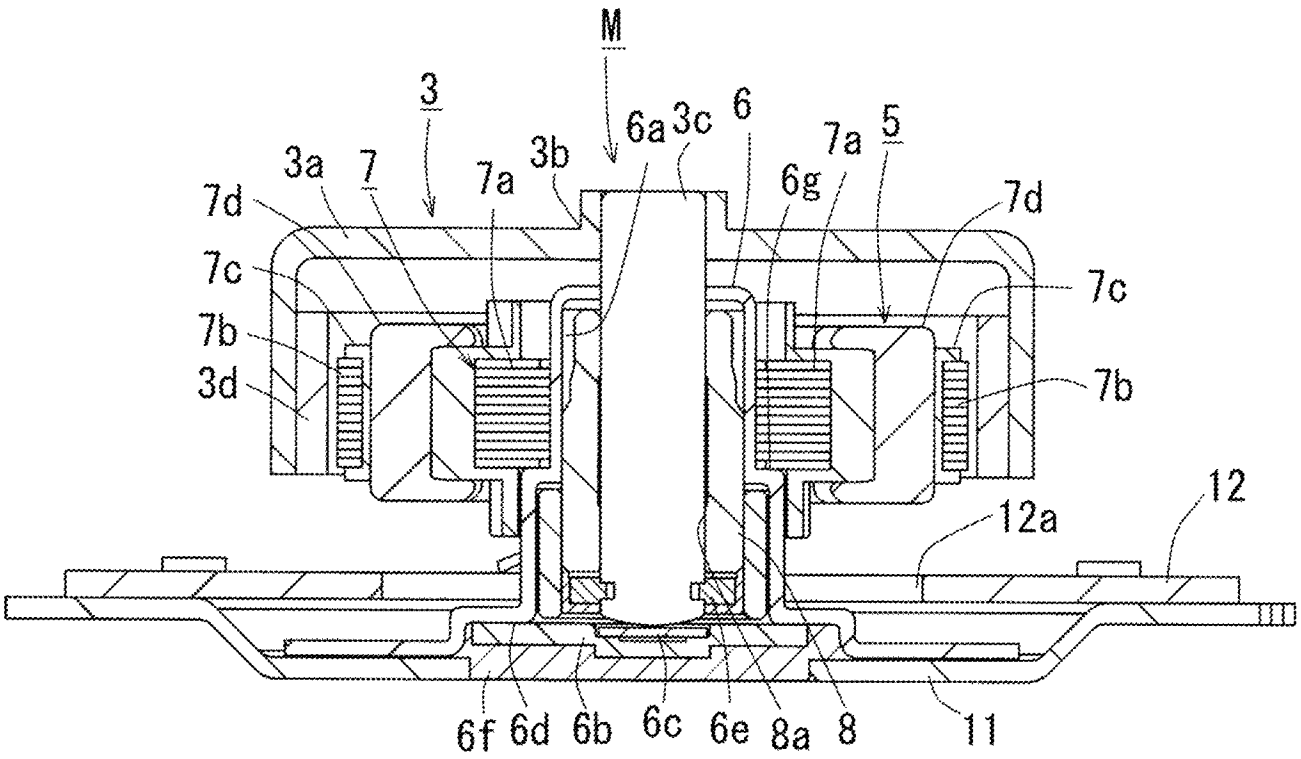
FIG. 5 is a vertical cross-sectional view of an outer rotor type motor illustrated in FIG. 1.

As illustrated in the cross-sectional view in FIG. 5, in the stator 5, a stator core 7 is adhesively fixed to an outer periphery of an axial-direction intermediate part of a stator housing 6 formed in a cylindrical shape. The stator core 7 is assembled while being positioned in the axial direction by the stator housing 6 being inserted into a center hole of an annular core back part 7*a*, and the stator core 7 being abutted to a stepped part 6*g* provided to the stator housing 6. The stator core 7 is provided with a plurality of pole teeth 7*b* projecting toward the radial-direction outer side from the core back part 7*a*. A circumference of the pole teeth 7*b* is covered by an insulator 7*c*, and a motor coil 7*d* is wound therearound. A coil lead of the motor coil 7*d* is electrically connected to a terminal part of a motor substrate 12 by soldering.

In the rotor 3, one end of a rotor shaft 3*c* is integrally assembled, by one of press fit, adhesion, shrink fit, etc., or combination thereof, to a hub 3*b* of a rotor yoke 3*a* formed in a cup shape. An annular rotor magnet 3*d* magnetized to N pole and S pole, alternately, is assembled to an inner peripheral surface of the rotor yoke 3*a*. The rotor yoke 3*a* is insert molded together with an impeller 2*c*. The rotor shaft 3*c* is inserted into a cylinder hole 6*a* of the stator housing 6, and is press-fitted into a cylinder hole 8*a* of an oil-impregnant sintered bearing 8 press-fitted into the stator housing 6. An insertion end part of the rotor shaft 3*c* is supported by being abutted to a thrust bearing 6*c* supported by a closing member 6*b* which closes the cylinder hole 6*a* of the stator housing 6. The closing member 6*b* is integrally assembled while being abutted to a concave part 6*d* of the stator housing 6. Moreover, a retainer washer 6*e* is fitted to the rotor shaft 3*c* at a vicinity of the insertion end portion, and the rotor shaft 3*c* is retained in the axial direction. The closing member 6*b* is sealed by a sealing material 6*f* being filled into the concave part 6*d* of the stator housing 6.

As illustrated in FIG. 1, in the centrifugal fan 2, a main plate 2*b* which continues from a hub 2*a* to the radial-direction outer side is formed in a dome shape. Air drawn in from an intake opening part 4*c* opposed to the hub 2*a* of the centrifugal fan 2 can be compressed and sent out to an annular air blowing path provided at a radial-direction outer side, by the impeller 2*c* formed on the main plate 2*b*. Moreover, the hub 2*a* and the main plate 2*b* which continues thereto of the centrifugal fan 2 form a dome-shaped space part on the opposite surface side from the intake opening part 4*c*. In the dome-shaped space part, the rotor 3 and the stator 5 of the motor M are accommodated to be overlapped with each other in the axial direction. Therefore, by reducing the axial direction dimension of the centrifugal blower 1, it can be made smaller and flatter than a centrifugal blower of the same size.

Figure 2:
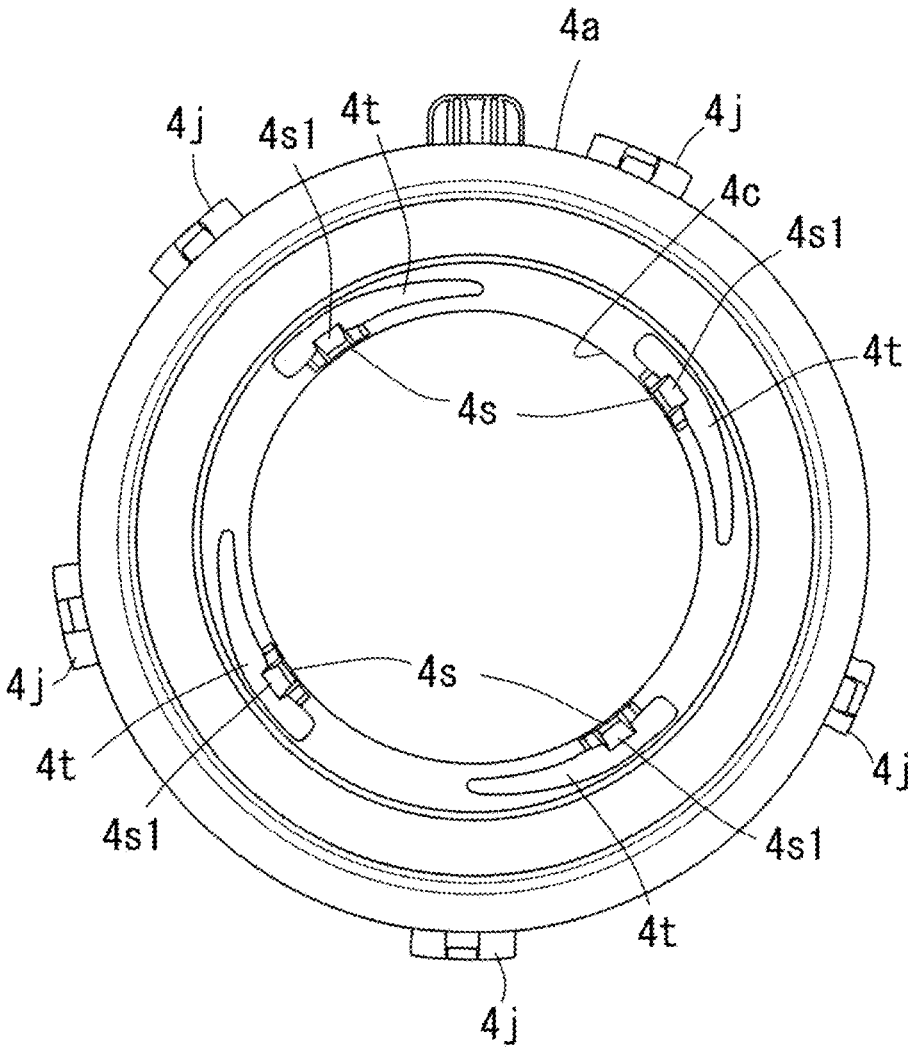
FIG. 2 is a plan view of a first case illustrated in FIG. 1.
Figure 3:
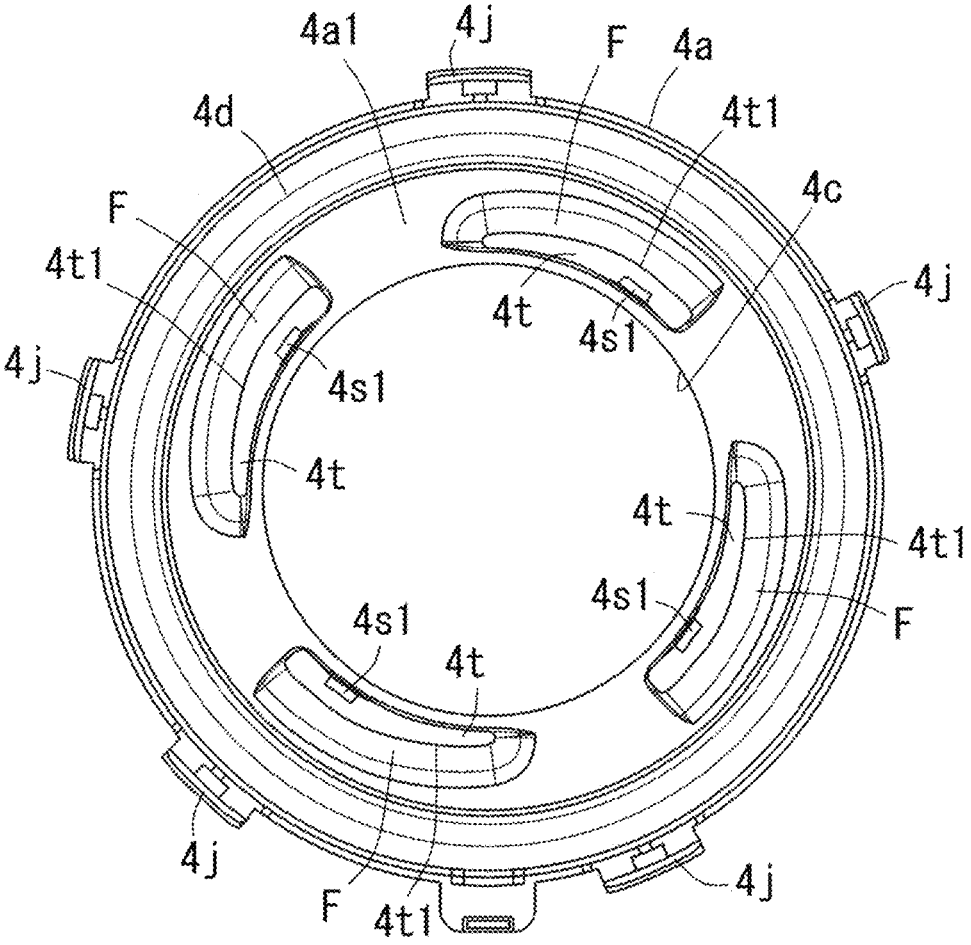
FIG. 3 is a plan view of the first case illustrated in FIG. 2 when seen from an inner side.

In FIG. 2, the intake opening part 4*c* is provided to a radial-direction middle part of the first case 4*a*, and as illustrated in FIG. 3, a first air blowing path 4*d* is formed at a radial-direction outer side. Note that the center of the intake opening part 4*c* is not required to strictly coincide with an axial line of the rotor shaft 3*c* of the motor M, as long as the position of the intake opening part 4*c* is near the radial-direction middle part of the case body 4, and the centrifugal fan 2 operates without lowering efficiency. The stator housing 6 is resistance-welded with a base plate 11 which has a sheet-metal shape covering a motor bottom part (see FIG. 5), and is integrally assembled to the second case 4*b*. As illustrated in FIG. 5, the motor substrate 12 is assembled to be overlapped on the base plate 11 in a state where the motor substrate 12 allows the stator housing 6 to be inserted into a substrate through-hole 12*a*. An energizing circuit is formed on the motor substrate 12.

Figure 4:
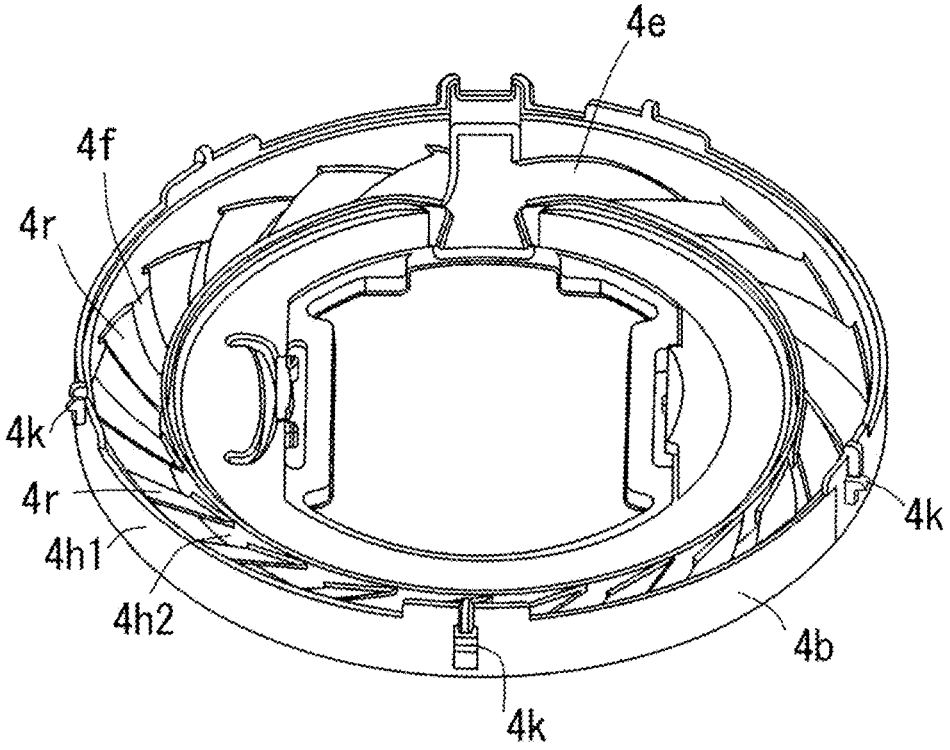
FIG. 4 is a perspective view of a second case illustrated in FIG. 1.

As illustrated in FIG. 4, a second air blowing path 4*e* to be combined with the first air blowing path 4*d* is formed at a radial-direction outer side of the second case 4*b*. The annular air blowing path is formed at the radial-direction outer side of the case body 4 by the first case 4*a* and the second case 4*b* being combined together. At a bottom-part outer peripheral side of the second case 4*b*, which becomes the second air blowing path 4*e*, discharge holes 4*f* to discharge pressurized and compressed air along the axial direction are bored at a plurality of positions in the circumferential direction. A plurality of diffuser panels 4*r* are installed between a bottom-part outer peripheral wall 4*h*1 and a bottom-part inner peripheral wall 4*h*2 provided to the bottom part of the second case 4*b*, and the discharge holes 4*f* are formed. The diffuser panels 4*r* discharge air which is discharged in the axial direction from the discharge holes 4*f* provided to the second air blowing path 4*e*, obliquely downwardly with respect to a rotational direction of the centrifugal fan 2, along an inclination of each diffuser panel 4*r*.

In FIG. 1, lock protrusions 4*s* are projectingly provided to a radial-direction outer side of the intake opening part 4*c* of the first case 4*a* at a plurality of positions (for example, four positions) in the circumferential direction. The lock protrusions 4*s* are provided at the plurality of positions in the circumferential direction for snap-fit locking such that the intake opening part 4*c* faces an attachment part of a seat air-conditioning duct, for example. On an outer peripheral side of each lock protrusion 4*s*, a removal hole 4*t* whose width becomes narrower from an upstream side to a downstream side in the rotational direction of the centrifugal fan 2, is provided to extend in an arc shape. A tip-end side of the lock protrusion 4*s* is provided with a lock part 4*s*1 in a wedge shape, and is formed to project over the removal hole 4*t* (see FIG. 2). As described above, the removal hole 4*t* whose width becomes narrower from the upstream side to the downstream side in the rotational direction of the centrifugal fan 2 is provided to extend on the outer peripheral side of the lock protrusion 4*s*. Therefore, the lock protrusion 4*s* can be resin-molded integrally with the first case 4*a* even when a mold undercut part is caused.

Figure 6A:
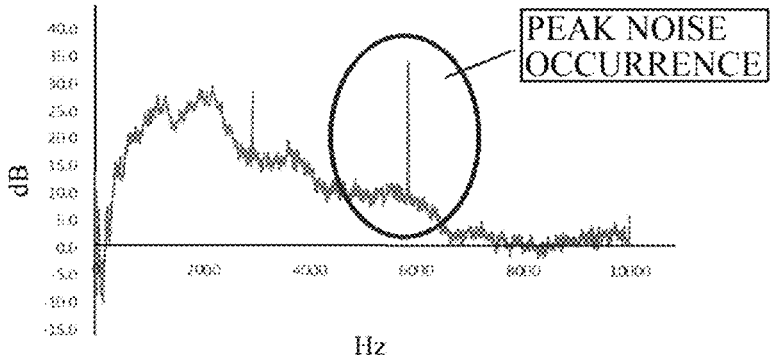
FIGS. 6A and 6B are graphs showing a frequency-noise level which indicates noise FFT analysis results before and after improvement.
Figure 6B:
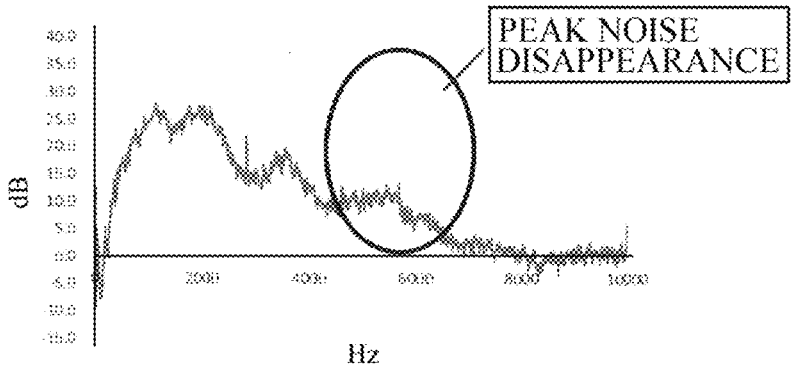

Moreover, in FIG. 3, a chamfered inclined surface F is formed continuously to a peripheral edge part 4*t*1 of the removal hole 4*t*, the peripheral edge part 4*t*1 facing to a side of an inner wall surface 4*a*1 of the first case 4*a*. The inclined surface F is chamfered to surround the outer peripheral side of the removal hole 4*t*. In this manner, by the peripheral edge part 4*t*1 of the removal hole 4*t*, which faces to the side of the inner wall surface 4*a*1 of the first case 4*a*, being chamfered, and the inclined surface F being formed continuously, occurrence of peak noise which depends on the number of blades and a rotational speed of the centrifugal fan 2 can be reduced (see FIG. 6B).

Moreover, the removal hole 4*t* is formed in a given range including and from a further upstream side to a further downstream side in the rotational direction of the centrifugal fan 2, of an outer-peripheral edge part of the intake opening part 4*c* at which the lock protrusion 4*s* is projectingly provided. Therefore, while easiness in deformation of the lock protrusion 4*s* during assembling and disassembling of the centrifugal blower 1 by snap-fit is maintained, pulsation of air due to rotation of the centrifugal fan 2 is dispersed, and pressure fluctuation can be suppressed.

According to the configuration, the centrifugal blower 1 can be provided, in which occurrence of peak noise is reduced by the shape of the removal hole 4*t* provided on the outer peripheral side of the lock protrusion 4*s* which is provided integrally to the case body 4, being improved. While easiness in deformation of the lock protrusion 4*s* during assembling and disassembling of the centrifugal blower 1 is maintained, pulsation of air due to rotation of the centrifugal fan 2 is dispersed, and pressure fluctuation can be suppressed.

Although the above embodiment is described while taking a vehicle-mounted seat air conditioning as an example, the embodiment is not limited to this, but it may be used for a centrifugal blower for HVAC (Heating, Ventilation, and Air Conditioning), and the like. Needless to say, even at a location other than vehicles, where remaining space is small and space for disposing a conventional air-conditioning air blower is difficult to be secured, the present invention is similarly applicable.

What is claimed is:

1. A centrifugal blower including a case body that accommodates therein a centrifugal fan and a motor adapted to rotary drive the centrifugal fan, and configured to draw in air from a radial-direction middle part of the case body and discharge compressed air from a radial-direction outer side of the case body, wherein the case body includes:

a first case configured to be assembled to cover the centrifugal fan, and provided with an intake opening part at a radial-direction middle part, and a first air blowing path formed at a radial-direction outer side; and a second case configured to axially support the motor to be rotatable, and provided with a second air blowing path formed on a radial-direction outer side of an outer-peripheral end part of the centrifugal fan, the second air blowing path being configured to be combined with the first air blowing path, and lock protrusions are projectingly provided to a peripheral edge part of the intake opening part of the first case at a plurality of positions, a removal hole of which a width becomes narrower from an upstream side to a downstream side in a rotational direction of the centrifugal fan is provided to extend on a radial-direction outer side of each lock protrusion, and a chamfered inclined surface is formed to continue to a peripheral edge part of the removal hole, the peripheral edge part facing to an inner wall surface of the first case.

2. The centrifugal blower according to claim 1, wherein the removal hole is formed in a given range including and from a further upstream side to a further downstream side in the rotational direction of the centrifugal fan, of the peripheral edge part of the intake opening part at which the lock protrusion is provided.

* * * * *